United States Patent [19]

Watson

[11] Patent Number: 4,789,194

[45] Date of Patent: Dec. 6, 1988

[54] LIFTING DEVICE FOR CONTAINERS

[75] Inventor: Norman F. Watson, Chipperfield, England

[73] Assignee: EKA Limited, Edinburgh, Scotland

[21] Appl. No.: 62,895

[22] Filed: Jun. 16, 1987

[30] Foreign Application Priority Data

Jun. 20, 1986 [GB] United Kingdom ..... 8615149

[51] Int. Cl.[4] ..... B66C 1/36; B66C 1/66

[52] U.S. Cl. ..... 294/82.1; 294/81.53; 294/81.54; 294/82.12; 294/82.24

[58] Field of Search ..... 294/67.1, 67.3, 68.3, 294/74, 81.1, 81.2, 81.3, 81.5, 81.53–81.56, 82.1–82.13, 82.17, 82.23, 82.24, 82.27, 82.35, 89; 410/82, 101, 102, 107, 111

[56] References Cited

U.S. PATENT DOCUMENTS

| | | | |
|---|---|---|---|
| 3,015,407 | 1/1962 | Fesmire et al. | 294/68.3 X |
| 3,343,861 | 9/1967 | Sinicki | 294/81.2 |
| 3,817,414 | 6/1974 | Peltonen | 294/81.54 X |
| 4,139,228 | 2/1979 | Varadi | 294/81.53 X |
| 4,427,228 | 1/1984 | Mattila | 294/82.24 |
| 4,541,662 | 9/1985 | Berg | 294/82.1 |

FOREIGN PATENT DOCUMENTS

| | | | |
|---|---|---|---|
| 703216 | 2/1965 | Canada | 294/82.1 |
| 145017 | 6/1985 | European Pat. Off. | 294/82.1 |
| 1802530 | 5/1970 | Fed. Rep. of Germany | 294/68.3 |
| 2227430 | 1/1974 | Fed. Rep. of Germany | 294/81.53 |
| 839991 | 7/1981 | U.S.S.R. | 294/81.53 |
| 1271299 | 4/1972 | United Kingdom | 294/81.53 |

*Primary Examiner*—Johnny D. Cherry
*Attorney, Agent, or Firm*—Cumpston & Shaw

[57] ABSTRACT

A lifting device for handling flat racks or containers fitted with ISO corner castings comprising a main support plate having a lifting pin projecting from one face for engagement in an end aperture in an ISO corner casting and a tubular support on the plate carrying a locking pin movable in a direction at right angles to the longitudinal axis of the lifting pin for connection in a further aperture in the side of the corner casting for holding the lifting pin firmly in the end aperture, a pivotal link on the plate for connecting it to a lift strap, and to a spreader bar. The invention preferably also incorporates a special device for varying the effective length of the lifting strap.

12 Claims, 4 Drawing Sheets

Fig. 6
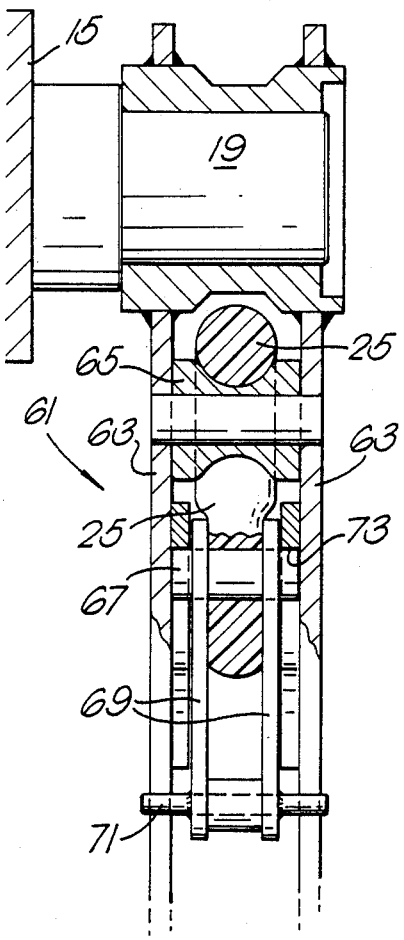
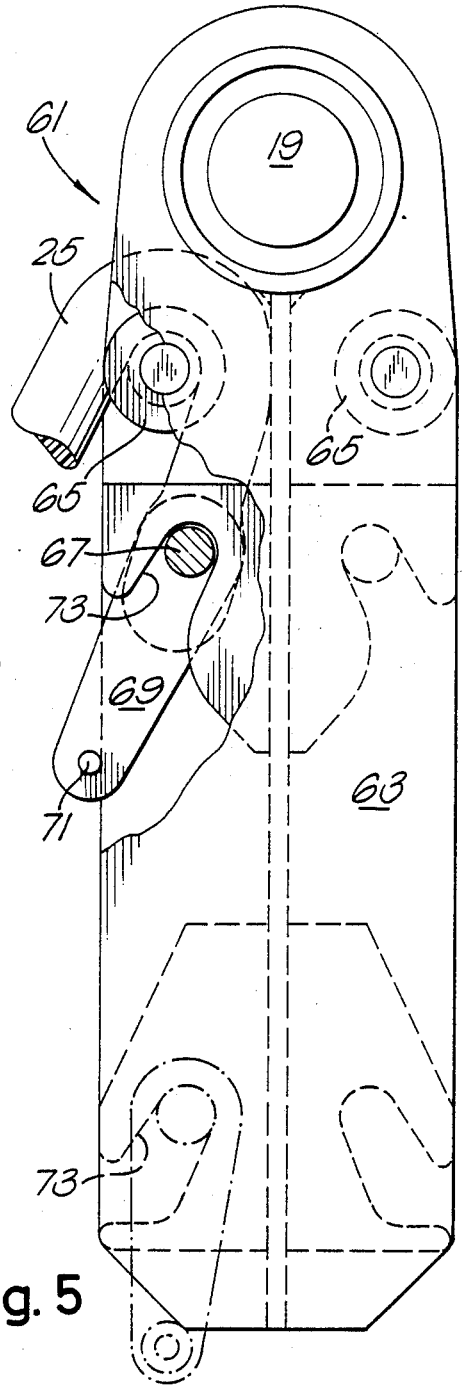
Fig. 5

LIFTING DEVICE FOR CONTAINERS

The present invention relates to a lifting device for containers and more especially to a flat rack or container lifting shoe for use with ISO corner castings provided on the flat rack or container, hereinafter called a flat rack. The invention also relates to variable length lifting straps for use with the lifting shoes.

Nowadays, goods are transported from one location to another in containers or on flat racks either by rail or by road and it is most important to be able easily to transfer the flat rack or container between the ground and either a flat bed rail truck (these can be of varying height) or a motor vehicle. What is more, it is not unusual for two or three flat racks to be located end to end on a flat bed rail truck with only a very small space between adjacent flat beds, making access to the ISO corner castings difficult.

Traditionally, flat racks are picked up with the aid of a dedicated vehicle fitted with front and rear extendable lifting booms which can swing in parallel arcs transversely of the vehicle, although we have developed a specially extended flat rack fitted with swinging lifting booms and which is itself demountably supported on a vehicle. The two lifting booms are then fitted with rectangular or triangular strap systems, i.e. vertical straps with a top spreader or inclined straps with a bottom spreader, to the bottom corners of which lifting shoes are fitted for engagement with the ISO corner castings. One known triangular, German lifting system has telescopic bottom spreaders at the ends of which hinged angled shoes are attached which have lifting pins which engage in the outer faces only of the ISO castings at each end of the flat rack. These hinged, angled shoes, because the lift pins engage in the outer faces of the ISO castings, can easily be damaged because the weight of the flat rack and its load is taken on lift pins which are out of alignment with the inclined lift straps and there is therefore always a moment on the lift shoes tending to buckle the shoes. Furthermore, the telescopic spreaders, which it is necessary to use with these hinged angled shoes which pick up on the outer faces only of the ISO castings, only have to be slightly bent for them not to extend and retract satisfactorily.

According to the present invention, we provide a lifting device for handling flat racks or containers fitted with ISO corner castings, comprising a first support plate having a lifting pin extending normally thereto, for engagement in an end aperture in an ISO corner casting on the flat rack, means for connecting said plate to a lift strap, and support means on said plate for supporting a locking pin which is movable in a direction at right angles to the longitudinal axis of the lifting pin for engagement with and disengagement from an aperture in the side of said ISO corner casting so that when engaged in said side aperture the lifting pin is held firmly in the end aperture.

Preferably, the support means comprises a plate extending at right angles to the first support plate and in which the locking pin is slidably and rotatably mounted, the locking pin having an enlarged head at its free end which can be inserted through the side aperture in the ISO casting and can then be twisted through 90° to hold the locking pin in position.

Preferably, the locking pin is provided with some form of spring-loaded latch device to maintain it in its engaged position, and with a radially extending locking handle at its end remote from its locking head for engagement in a seat provided by an extension of the first support plate on that side of the plate supporting the locking pin remote from the lifting pin.

A hoop-shaped handle may be connected to the first support plate.

Preferably, the means for connecting the first support plate with a lifting strap comprises an aperture in the end of the plate remote from the means for supporting the locking pin by means of which a lifting link having three apertures therein may be pivotally connected to the first support plate. The three apertures in the link are in alignment and are for pivotally connecting one end of the link to the first support plate, an opposite end to a lifting strap, the third aperture being intermediate the other two and for pivotal connection to a spreader bar of fixed length.

Normally, when lifting a load onto or from support surfaces of varying heights, the difference in height is accommodated entirely by means of an extendable lifting boom. However, there is a limit to the amount that the swinging lifting booms for use with the lifting device of the present invention can be extended because the flat bed rail trucks of varying height on which the flat racks are transported are often used on railway systems with overhead power lines.

Accordingly, the present invention also provides means for varying the effective length of the inclined lifting straps, said means preferably comprising a pair of spaced depending plates which may be connected to the end of a lifting boom and with which an upper end of each inclined strap is adjustably connected, each pair of plates supporting therebetween a pair of pulley means, e.g. grooved rollers, about which the upper end portions of the respective straps are entrained, there being means on the free end of each strap for engagement with any one of a plurality of latch devices on the plates.

Preferably, the plates are provided with downwardly opening slots with which a transverse bar on the free end of the respective straps may be engaged. Accordingly, when the bar is engaged with a pair of slots adjacent its associated grooved roller the straps will be of maximum length but the straps can be shortened by disengaging the bar from said pair of slots and pulling the bar downwardly so as to engage with a pair of slots spaced further from the associated grooved roller.

A lifting device for a flat rack and in accordance with the present invention is now described by way of example with reference to the accompanying drawings, in which:

FIG. 5 is an enlarged end elevational view of that portion of FIG. 1 identified at V, and FIG. 6 is a partial end elevation corresponding to FIG. 1.

Figure 1:
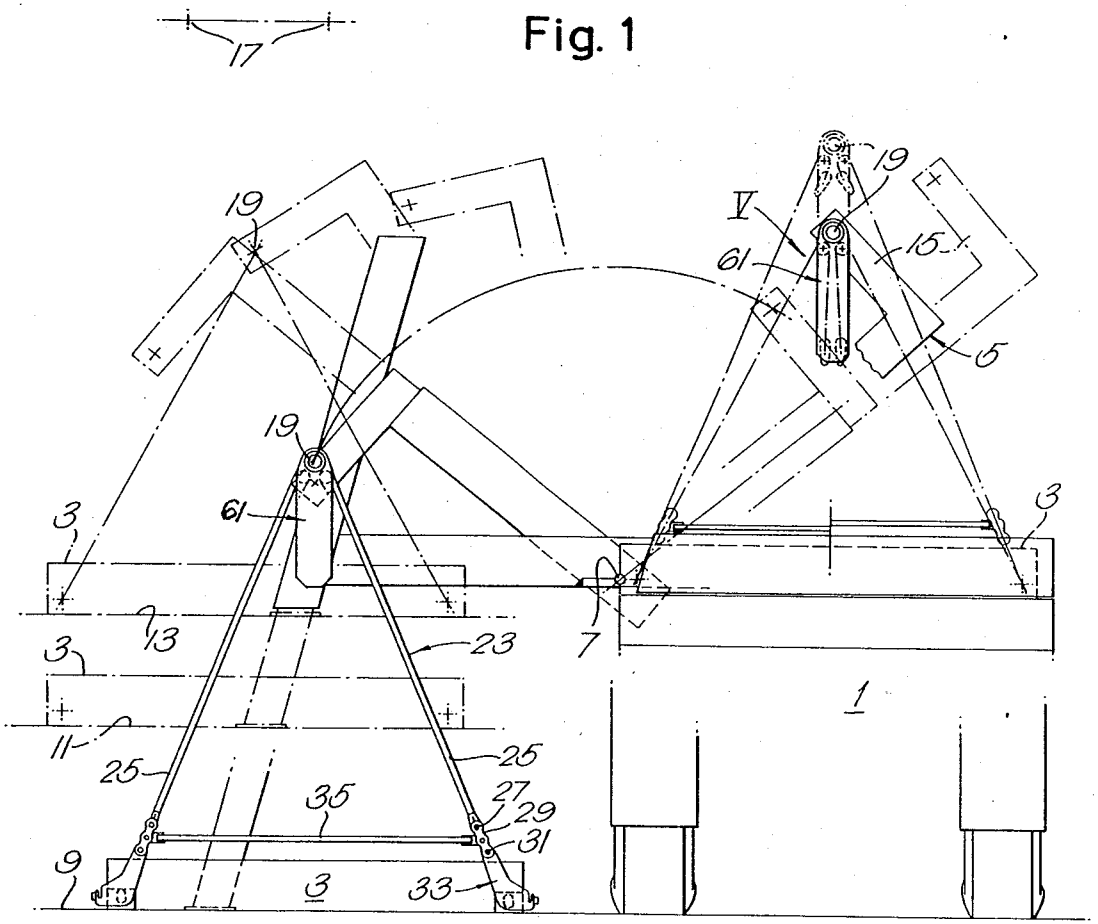
FIG. 1 is an end view of a vehicle fitted with the lifting device and showing various alternative positions of the flat rack.

Referring to the drawings, FIG. 1 shows the rear of a vehicle 1 on which is supported a flat rack 3, the vehicle being provided with front and rear extendable lifting booms 5 mounted for pivotal movement on the vehicle about axes 7 so as to swing in parallel arcs transversely to the longitudinal axis of the vehicle 1. Each boom 5 is shown in various different positions, e.g. for handling the flat rack 3 when it is on the back of the vehicle 1 or resting on the ground at 9 or on a low flat bed rail truck 11 or a higher flat bed railtruck 13. The boom 5 has an end portion 15 which is offset at right angles to the remainder of the boom so that even at maximum extension overhead power lines (represented at 17) of a railway system will not be fouled.

The booms 5 are each connected to a trunnion bar 19 (which may extend between plate assemblies 61) associated with a triangular strap assembly 23 for lifting the flat rack 3, one being located at each end of the flat rack. Each strap assembly 23 comprises two inclined straps 25, each connected in a manner which will hereinafter be described in further detail, at its upper end to the plate assembly 61 and at its lower end to a link 29, by means of a pivot pin 27 located in an aperture in one end of the link 29. At its opposite end a further aperture is provided in the link 29 to receive a pivot pin 31 by means of which link 29 is connected to one end of a lifting shoe 33. A third central aperture in line with the other two apertures is provided in the link 29 to enable the two links 29 to be pivotally interconnected by means of a bottom spreader bar 35 of fixed length.

Figure 2:
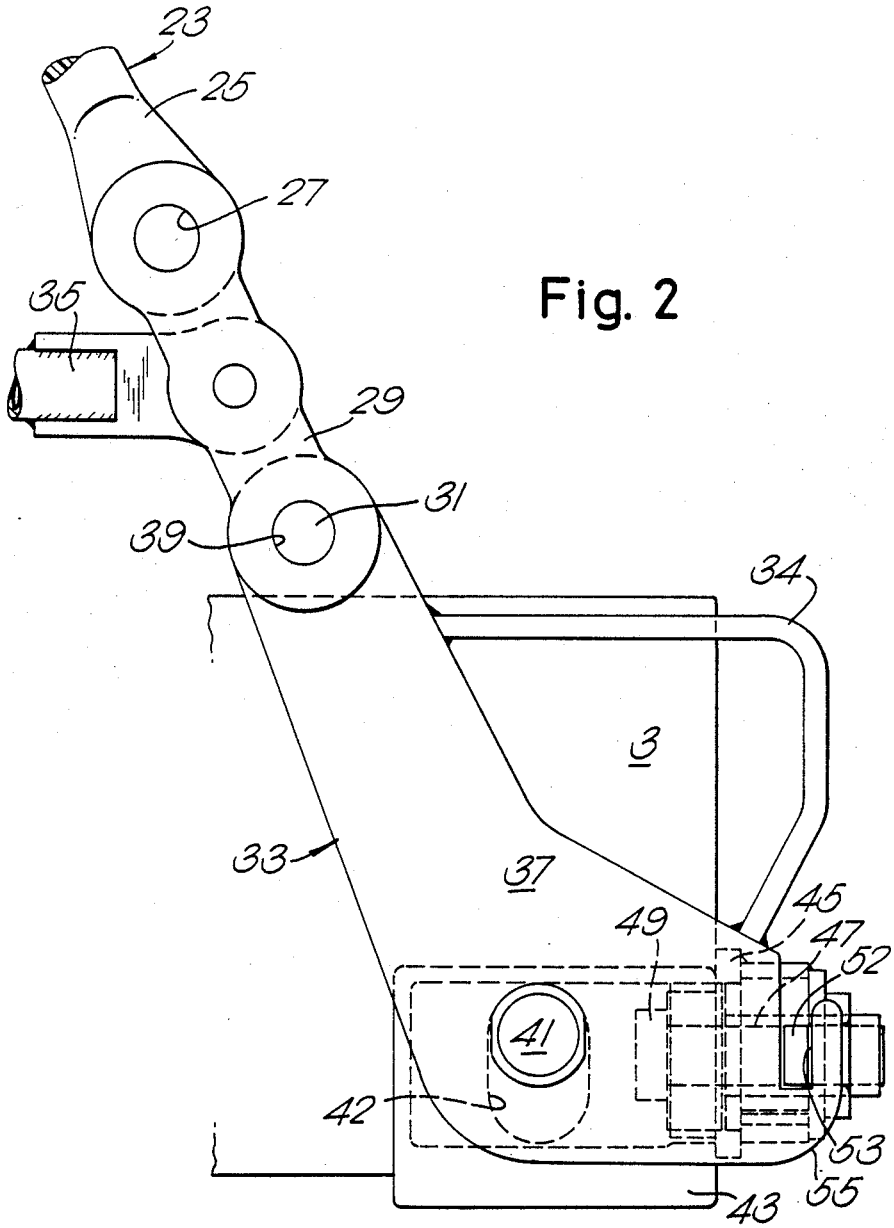
FIG. 2 is an end elevation, to a considerably greater scale than FIG. 1, of a lifting device.
Figure 4:
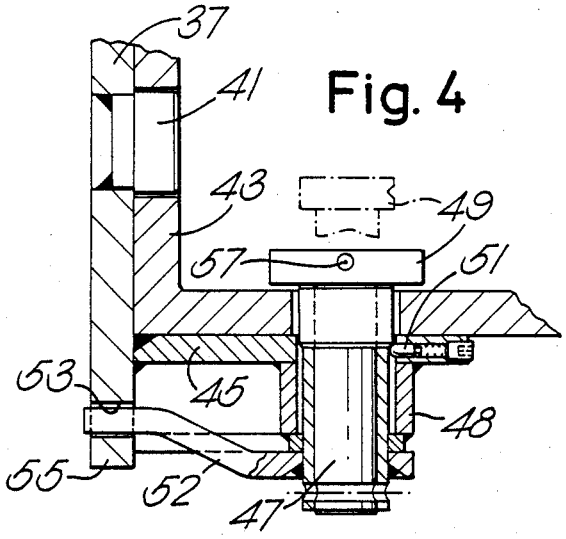
FIG. 4 is a plan view of the lifting device.
Figure 3:
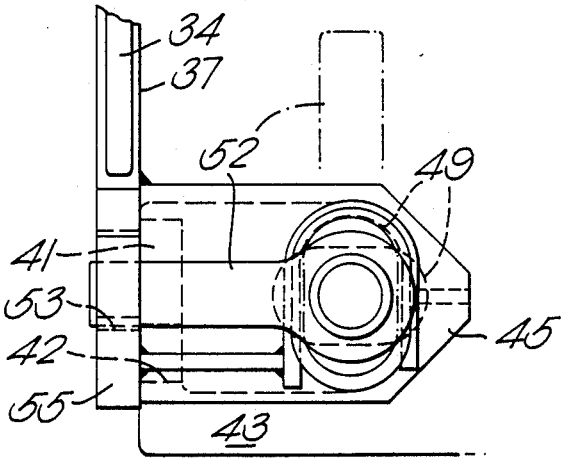
FIG. 3 is a side elevation of the lifting device of FIG. 2.

Referring now more especially to FIGS. 2–4, the lifting shoe 33 comprises a first support plate 37 having at its upper end an aperture 39 to receive the pivot pin 31 and at its bottom end being provided with a transversely extending lifting pin 41 arranged to be located in an end aperture 42 in an ISO corner casting 43 of the flat rack 3. A hoop-shaped handle 4 is connected to the plate 37 to assist in handling the shoe.

A further plate 45 projects from the first support plate 37 at right angles thereto to support a locking pin 47 extending at right angles to the lifting pin 41, there being a pin housing 48 carried by the support plate 45 in which the locking pin 47 is slidably and rotatably mounted. Spring biassing means may be provided for the locking pin 47 or, alternatively or additionally, a spring loaded detent 51 may be provided to hold it in its different positions. The locking pin 47 has an enlarged elongated head 49 at one end which can be inserted into the side aperture in the ISO corner casting 43 but which cannot be removed therefrom once the locking pin 47 has been turned through 90° (the two alternative positions of the head 49 are clearly illustrated in FIGS. 3 and 4). To assist in rotating the locking pin 47 and in moving it axially, its end remote from the locking head 49 is provided with a locking handle 52 which, when the head 49 is engaged in the corner casting, can be located in a seat 53 provided in an extension 55 of the plate 37. It will thus be appreciated that to engage the lifting pins 41 in the end apertures in the ISO corner castings 43, the locking pins 47 are first retracted so that their enlarged heads 49 are held in the housing 48 by means of the spring-loaded detent 51 engaging in an aperture 57 in the head 49. After the lifting pins have been engaged, the locking pins 47 can be moved axially so that their enlarged heads will pass through the elongated side apertures in the ISO castings 43 whereupon the pins 47 are turned through 90° so as to engage the end portions of the enlarged heads 49 behind the side walls defining the apertures in the castings 43.

Once all four lifting shoes at each horizontal corner of the flat rack have been engaged with the corner castings 43, the flat rack can be moved from one location to another by extending and/or swinging the lifting booms 5 as desired. This will immediately cause a tension in the lifting straps 25 which will act through the links 29 on the shoes 33 in a straight line through the apertures in the link 29, through the pin 31 connecting the link 29 to the shoes 33 and through the centre of the lifting pin 41. This means that the full weight of the flat rack is taken by the four lifting pins 41 and in theory at least there should be no load whatsoever on the locking pin 47 which merely ensures that the lifting pins cannot become displaced from the end apertures in the corner castings 43. Furthermore, as is clearly apparent from FIG. 4, the total width of the support plate 37 and its projecting lifting pin 41 is only about 4 cms which means that the space between adjacent flat racks need be little more than this to enable the lifting device of the present invention to be used.

Because the lifting forces acting on the shoes act in a straight line through the pivot pin 31 and the plate 37 to the lifting pin 41, the chances of any damage occurring to the lifting shoes are small. Furthermore, of course, because the locking pins can be moved axially a fixed length spreader bar can be used with the lifting straps and this means that slight bending of the spreader bar will not be detrimental to the operation of the lifting shoes.

In order to be able to handle flat racks located at different heights above the ground and yet ensure that the lifting booms 5 do not foul overhead power lines of railway systems, it is necessary to be able to change the length of the inclined straps 25. To enable this to be done simply, a plate assembly 61 which is shown in detail in FIGS. 5 and 6 is provided to which the upper ends of straps 25 are connected. The plate assembly 61 comprises two spaced plates 63 supported from trunnion 19 and between which are located grooved rollers 65 around which the upper end portions of the straps 25 are entrained. The upper end of each strap 25 terminates in an eye through which a transverse pin 67 is passed and connected to the pin 67 outwardly of the strap 25 are a pair of spaced levers 69 to the bottom end of which a transverse gripping bar 71 is connected. This enables an operator to adjust the effective length of the straps 25 by pulling on the bar 71 and to locate the pin 67 in a selected one of two or more downwardly facing slots 73 in the outer edges of the plates 63, the arrangement being such that when the straps 25 are tensioned, the pin 67 will be seated in the closed end of the selected slot 73. Obviously, the slot 73 closest to the associated grooved roller 65 will be used when a maximum length of strap 25 is required and that furthest from the associated grooved roller 65 will be used when the shortest possible strap 25 is required. This means that the same straps 25 can be used for handling the flat racks regardless of their actual or intended height above the ground.

It will be appreciated that the lifting shoes disclosed herein could be used without the adjustable length straps disclosed herein or with a different length adjustment arrangement and the strap length adjustment device disclosed herein could be used without the lifting shoes disclosed herein or with alternative lifting shoes.

It will of course be understood that the present invention has been described above purely by way of example and modifications of detail can be made within the scope of the invention.

We claim:

1. A lifting device for handling flat racks or containers fitted with ISO corner castings comprising a first support plate; a lifting pin having a longitudinal axis extending normally to the support plate for engagement in an end aperture in an ISO corner casting on the flat rack; means for connecting said plate to a lift strap; support on said plate; and a locking pin carried by said support means and radially movable along an axis at right angles to the longitudinal axis of the lifting pin for engagement with and disengagement from an aperture in the side of said ISO corner casting.

2. A lifting device according to claim 1 wherein the support means comprises a plate extending at right angles to the first support plate and said locking pin is slidably and rotatably mounted in said support means, the locking pin further comprising a locking head.

3. A lifting device according to claim 1 further comprising spring-loaded detent means for maintaining said locking pin in an engaged position and in which said locking pin comprises a radially extending locking handle.

4. A lifting device according to claim 1 further comprising a hoop-shaped handle connected to the support plate.

5. A lifting device according to claim 1 wherein the means for connecting the support plate to a lifting strap comprises an aperture in the support plate and a lifting link having three apertures therein, said lifting link pivotally connected to the first support plate.

6. A lifting device according to claim 5 wherein the three apertures in the lifting link are aligned for pivotally connecting one end of the link to the first support plate, an opposite end to a lifting strap, and the third aperture is intermediate the other two for pivotal connection to a spreader bar of fixed length.

7. A lifting device according to claim 1 further comprising a pair of spaced depending plates adapted to be connected to the end of a lifting boom; first and second inclined straps adjustably connected to said plates, a pair of pulley means supported by said plates about which the upper end portions of the respective straps are entrained, and means on the free end of each strap for engagement with the plates.

8. A lifting device according to claim 7 wherein the plates comprises a plurality of downwardly opening slots.

9. A lifting device according to claim 8 in which said downwardly opening slots are adjacent said pulley means, and further comprising a second pair of slots spaced further from said pulley means.

10. A lifting device for ISO corner castings comprising:

a first support plate;

a lifting pin having a longitudinal axis perpendicular to the support plate for engaging an end aperture in an ISO corner casting;

means for connecting said plate to a lift strap;

support means on said plate;

a locking pin carried by said support means and movable in a direction perpendicular to the longitudinal axis of the lifting pin; and spring loaded detent means for maintaining said locking pin in an engaged position; and in which said locking pin comprises a radially extending locking handle.

11. A lifting device for ISO corner castings comprising:

a first support plate;

a lifting pin having a longitudinal axis perpendicular to the support plate for engaging an end aperture in an ISO corner casting;

means for connecting said plate to a lift strap;

support means on said plate;

a locking pin carried by said support means and movable in a direction perpendicular to the longitudinal axis of the lifting pin;

a pair of spaced depending plates adapted to be connected to the end of a lifting boom;

pulley means supported by said plates;

first and second inclined straps having end portions entrained around said pulley means; and means on the ends of said straps for adjustably engaging said plates.

12. A lifting device for ISO corner castings comprising:

a first support plate;

a lifting pin having a longitudinal axis perpendicular to the support plate for engaging an end aperture in an ISO corner casting;

an aperture in the first support plate for connecting the plate to a lifting link;

a lifting link having three aligned apertures;

a first aperture for pivotally connecting one end of the link to the support plate, a second aperture for connecting an opposite end of the link to a lifting strap, and a third aperture intermediate the first and second apertures for pivotal connection to a spreader bar;

support means on said plate;

a locking pin carried by said support means and movable in a direction perpendicular to the longitudinal axis of the lifting pin; and spring loaded detent means for maintaining said locking pin in an engaged position; and in which said locking pin comprises a radially extending locking handle.

* * * * *